United States Patent [19]

Ohba et al.

[11] Patent Number: 4,933,520

[45] Date of Patent: Jun. 12, 1990

[54] ELECTRICAL CONTACT FOR USE IN ELECTROMAGNETIC RELAY

[75] Inventors: Masatoshi Ohba, Kyoto; Kazuo Ozawa, Hirakata, both of Japan

[73] Assignee: Omron Tateisi Electronics Company, Kyoto, Japan

[21] Appl. No.: 247,471

[22] Filed: Sep. 21, 1988

[30] Foreign Application Priority Data

Sep. 21, 1987 [JP] Japan ..... 62-238030

[51] Int. Cl.[5] ..... H01H 1/02

[52] U.S. Cl. ..... 200/268; 200/266

[58] Field of Search ..... 200/268, 269, 270, 262, 200/266, 267; 204/192.17; 427/126.5; 428/642, 672

[56] References Cited

U.S. PATENT DOCUMENTS

| | | | |
|---|---|---|---|
| 3,009,840 | 11/1961 | Emeis | 428/672 X |
| 3,017,532 | 1/1962 | Talmey | 313/141 |
| 3,222,489 | 12/1965 | Chaikin | 200/270 X |
| 3,238,342 | 3/1966 | Chaikin | 200/270 |
| 3,853,382 | 12/1974 | Lazar | 439/190 |
| 4,141,727 | 2/1979 | Shida et al. | 200/270 X |
| 4,337,133 | 6/1982 | Augis et al. | 204/192.17 |
| 4,507,633 | 3/1985 | Minks | 335/202 |
| 4,529,667 | 7/1985 | Shiga et al. | 204/40 X |
| 4,540,861 | 9/1985 | Okumura et al. | 200/266 X |
| 4,626,479 | 12/1986 | Hosoi et al. | 428/672 X |
| 4,795,660 | 1/1989 | Cooray et al. | 427/126.5 X |

FOREIGN PATENT DOCUMENTS

| | | | |
|---|---|---|---|
| 0118841 | 9/1984 | European Pat. Off. . | |
| 0118843 | 9/1984 | European Pat. Off. | 335/202 |
| 1190199 | 4/1965 | Fed. Rep. of Germany . | |
| 877647 | 12/1942 | France . | |
| WO86/01636 | 3/1986 | PCT Int'l Appl. . | |

*Primary Examiner*—Renee S. Luebke

*Attorney, Agent, or Firm*—Foley & Lardner, Schwartz, Jeffery, Schwaab, Mack, Blumenthal & Evans

[57] ABSTRACT

An electrical contact is provided for use in an electromagnetic relay. The electrical contact includes an outer coating containing an element of the VA Group such as antimony, arsenic, phosphorus or bismuth. Thus, the electrical contact does not serve as a catalyst for oxidizing any organic gases which may be produced during the operation of the electromagnetic relay. Accordingly, oxidation of the gases is reduced, carbon generation is suppressed and high reliability of the contact can be achieved.

12 Claims, 3 Drawing Sheets

ELECTRICAL CONTACT FOR USE IN ELECTROMAGNETIC RELAY

BACKGROUND OF THE INVENTION

1. Field of the Invention

This invention relates to an electrical contact, and more particularly, to an electric contact employed, for example, in an electromagnetic relay.

2. Related Art

Sealed electromagnetic relays typically comprise a case including a cover and a terminal base which are made of a synthetic resin material. If the temperature of the environment where the relay is used is too high, organic gases are generated from the synthetic resin. Since the case is sealed, the gases remain inside the case and arcing and frictional energies released during the switching of the relay contacts cause the gases to oxidize to carbon. This carbon collects over the contacts to cause contact failure.

In the past, evacuation of the organic gases has been attempted in order to prevent carbon build up. It is impossible, however, to completely evacuate the organic gases, and the remaining gases consequently produce carbon. In electromagnetic relays for switching low-level signals, the electrical contacts are generally made of a precious metal such as gold. Since the precious metal serves as a catalyst, a great amount of carbon easily develops.

A life test of a contact which is made of 90% gold (Au) and 10% silver (Ag) by weight was conducted. The contact was tested with a load of 18 Vdc with 45 mAdc connected thereto and at a switching frequency of 2 Hz. The organic gases were previously evacuated before the test. FIG. 8 represents contact resistance versus the number of contact switchings as the result of the test. As FIG. 8 shows, the contact resistance increases to a great value, although it does not cause contact failure, as the number of switchings increases. In addition, FIG. 8 shows that the contact resistance excessively fluctuates.

OBJECTS AND SUMMARY OF THE INVENTION

It is, therefore, an object of the present invention to provide an electrical contact which is highly reliable.

A further object is to provide an electrical contact which does not serve as a catalyst for the oxidation of the organic gases generated from the synthetic resin.

Another object of this invention is to provide an electrical contact which maintains a low and stable contact resistance even after a great number of contact switchings.

According to the present invention, the foregoing and additional objects are attained by providing an electrical contact for an electromagnetic relay. This electrical contact is coated with an element of the VA Group, which does not serve as a catalyst for the oxidation of any organic gases that may be generated during the operation of the electromagnetic relay. As a result a low and stable contact resistance can be maintained even after a number of contact switchings.

BRIEF DESCRIPTION OF THE DRAWINGS

The above and other objects, advantages and features of this invention will be more fully understood and appreciated when considered in conjunction with the following figures, wherein.

DETAILED DESCRIPTION OF THE PREFERRED EMBODIMENTS

Figure 1:
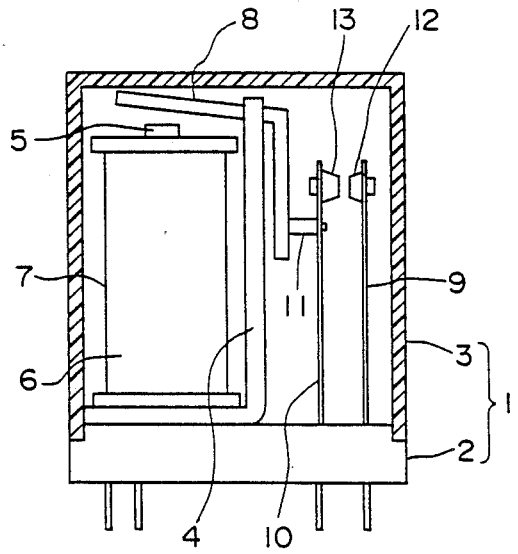
FIG. 1 is a longitudinal sectional view of an electromagnetic relay incorporating electric contacts according to a preferred embodiment of this invention.

A preferred embodiment of this invention is described below. In FIG. 1, a case 1 includes a terminal base 2 made of a synthetic resin material, and a cover 3 also made of a synthetic resin material is fixed to base 2. An iron core 5 is fixed to an L-shaped yoke 4 which is in turn fixed to base 2 by rivets (not shown). An electromagnetic coil 6 is disposed around iron core 5. Thus, yoke 4, iron core 5 and coil 6 form an electromagnet 7. A movable iron member 8 is pivotally supported at the tip of the upstanding portion of yoke 4. A stationary member 9 and a movable member 10 are disposed on base 2. Movable member 10 is actuated by the movable iron member 8 via a contact driving card 11. A stationary contact 12 is fixed at the tip of stationary member 9, and a movable contact 13 horizontally opposite contact 12 is fixed at the tip of movable member 10.

Figure 2:
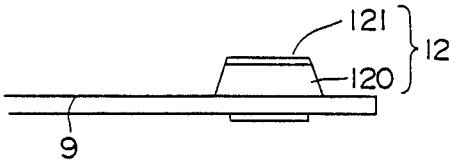
FIG. 2 shows a stationary contact of FIG. 1.
Figure 3:
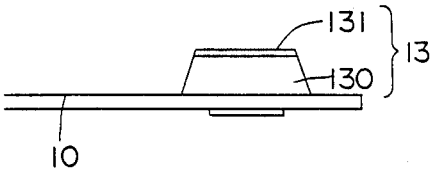
FIG. 3 shows a movable contact of FIG. 1.

As shown in FIG. 2, the stationary contact 12 comprises a main body 120 and a coating 121 formed thereover. Main body 120 is made of 90% gold and 10% silver by weight. Turning to FIG. 3, movable contact 130 includes a main body 130 and a coating 131 formed over body 130. Like main body 120, main body 130 is made of 90% gold and 10% silver by weight.

Coatings 121 and 131 contain an element of the VA Group, such as antimony (Sb) in the preferred embodiment, which is ion-plated over main bodies 120 and 130 in an argon (Ar) atmosphere using a hollow cathode discharging device. The conditions for the ion-plating are:

Electron beams emitting voltage and current: 25 Vdc, 180Adc

Argon atmosphere pressure $\leqq$0.12 Pascal (Pa)

Substrate biasing voltage: - 20 Vdc

Figure 4:
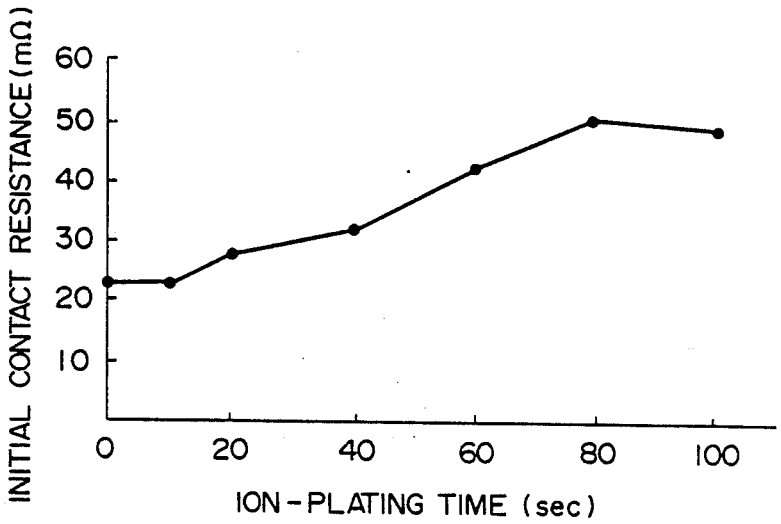
FIG. 4 shows a graph representing initial contact resistance versus ion-plating time.
Figure 5:
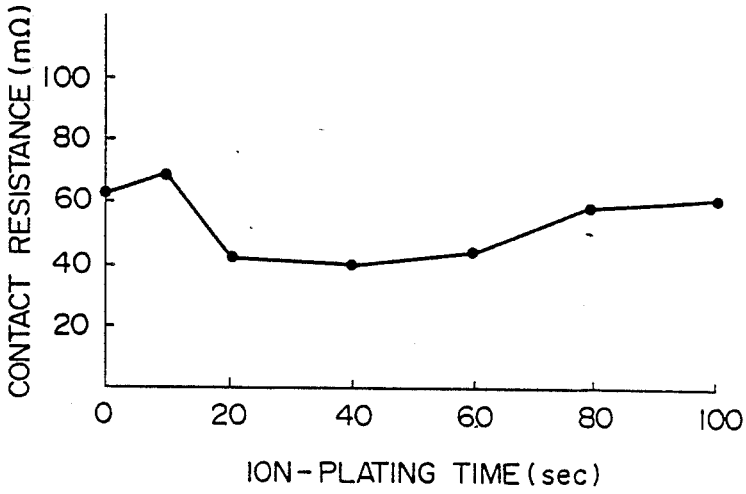
FIG. 5 shows a graph representing contact resistance after a predetermined number of switchings versus ion-plating time.

FIG. 4 shows a graph representing initial contact resistance versus ion-plating time, and FIG. 5 shows a graph representing contact resistance after a predetermined number ($10^6$) of contact switchings. In FIG. 4, the initial contact resistance is resistance before conducting a switching test. FIGS. 4 and 5 reveal the contact resistance is stable over 20 sec. to 40 sec. of the ion-plating. Therefore, the ion-plating is preferably conducted for 20 sec. to 40 sec.

Contacts 12 and 13 do not serve as a catalyst for speeding the oxidation of the organic gases because contacts 12 and 13 are covered with coatings 121 and 131. The oxidation of the organic gases is accordingly reduced even if they are produced in case 1 during the operation of the electromagnetic relay. Consequently, carbon generation is suppressed and high reliability of the contacts can be obtained.

During the ion-plating process, bombard cleaning using glow discharge is conducted in the argon atmosphere. The bombard cleaning removes organic films (not shown) which are formed on the main bodies 120 and 130 during the contact producing process. These organic films are detrimental to the contact reliability and remain even after a contact rinsing process. The low and stable initial contact resistance can thus be obtained by removal of these films.

Figure 6:
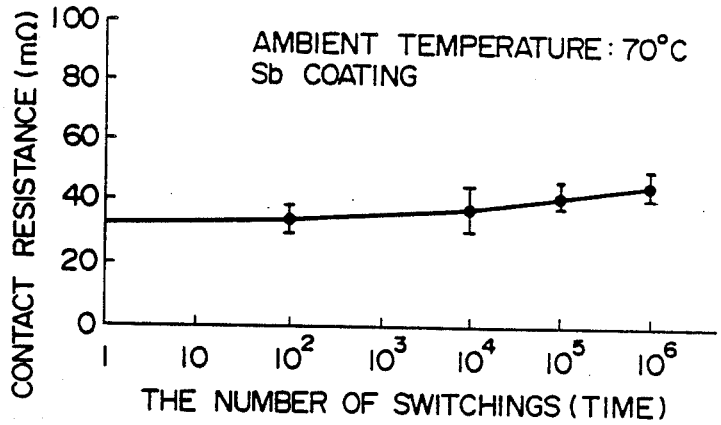
FIG. 6 shows a graph representing contact resistance versus the number of switchings of a contact coated with antimony (Sb) according to the present invention.

FIG. 6 shows a graph representing the contact resistance at an ambient temperature of 70° C. versus the number of contact switchings as the result of a life test of a contact coated with Sb. The conditions of the test are:

Load: 18 Vdc, 45 mAdc

Switching frequency: 2 Hz

As shown in FIG. 6, the contact resistance only slightly increases even if the number of contact switchings becomes great.

Figure 7:
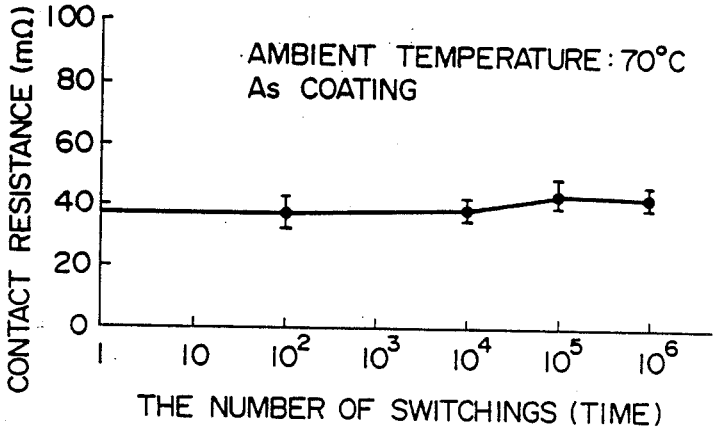
FIG. 7 shows a graph representing contact resistance versus the number of switchings of a contact coated with arsenic (As) according to the present invention.
Figure 8:
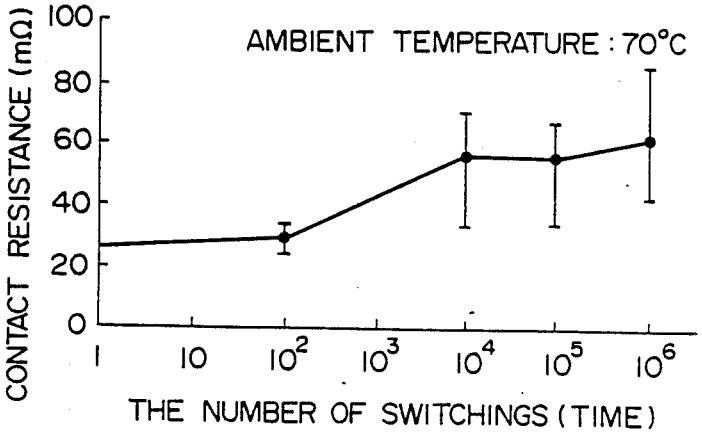
FIG. 8 shows a graph representing contact resistance versus the number of switchings of a contact which has no coating thereon.

Arsenic (As), another element of the VA Group, can be ion-plated over main bodies 120 and 130. FIG. 7 shows a graph representing the contact resistance at an ambient temperature of 70° C. versus the number of switchings of a contact coated with arsenic. FIG. 7 is the result of a life test of the contact, the conditions of which are the same as those of the test of the contact coated with Sb. Similarly, the contact resistance only slightly increases even after a great number of contact switchings.

Phosphorus (P) or bismuth (B) can be coated over main bodies 120 and 130 instead of Sb or As. In addition, other coating methods such as evaporation and sputtering can be applied. Moreover, contacts 12 and 13 can be made of a material containing an element of the VA Group.

The above description and the accompanying drawings are merely illustrative of the application of the principles of the present invention and are not limiting. Numerous other arrangements which employ the principles of the invention and which fall within its spirit and scope may be readily devised by those skilled in the art. Accordingly, the invention is not limited by the foregoing description, but only limited by the scope of the appended claims.

What is claimed is:

1. An electrical contact body comprising:

(a) a first material wherein said first material includes about 90% gold and 10% silver and at least a second material;

(b) said second material including an element from the VA group.

2. An electrical contact device for use in an electromagnetic relay comprising:

a stationary member;

a movable member; and contacts fixed opposite each other on said movable and stationary members;

wherein each of said contacts includes a first material and at least a second material, said first material including gold and silver and said second material including an element of the VA group.

3. A contact according to claim 2 wherein said first material includes about 90% gold and 10% silver.

4. A contact according to claim 2 wherein said second material includes antimony.

5. A contact according to claim 2 wherein said second material includes arsenic.

6. A contact according to claim 2 wherein said second material includes phosphorus.

7. A contact according to claim 2 wherein said element in said second material is bismuth.

8. An electrical contact device for use in an electromagnetic relay comprising:

a stationary member;

a movable member;

contacts fixed opposite each other on said movable and stationary members;

said contacts being coated with an outer surface containing an element of the VA Group.

9. An electrical contact device according to claim 8 wherein said element is antimony.

10. An electrical contact device according to claim 8 wherein said element is arsenic.

11. An electrical contact device according to claim 8 wherein said element is phosphorus.

12. An electrical contact device according to claim 8 wherein said element is bismuth.

* * * * *